US007377315B2

(12) United States Patent
Hall et al.

(10) Patent No.: US 7,377,315 B2
(45) Date of Patent: May 27, 2008

(54) COMPLAINT COVERING OF A DOWNHOLE COMPONENT

(76) Inventors: David R. Hall, 2185 S. Larsen Pkwy., Provo, UT (US) 84606; Scott S. Dahlgren, 2185 S. Larsen Pkwy., Provo, UT (US) 84606

( * ) Notice: Subject to any disclaimer, the term of this patent is extended or adjusted under 35 U.S.C. 154(b) by 296 days.

(21) Appl. No.: 11/164,572

(22) Filed: Nov. 29, 2005

(65) Prior Publication Data

US 2007/0119589 A1 May 31, 2007

(51) Int. Cl.
*E21B 17/00* (2006.01)

(52) U.S. Cl. ..... 166/242.1; 166/65.1; 166/66

(58) Field of Classification Search ..... 166/380, 166/65.1, 66, 242.1
See application file for complete search history.

(56) References Cited

U.S. PATENT DOCUMENTS

| | | | |
|---|---|---|---|
| 1,817,772 | A | 8/1931 | Sipe |
| 1,977,175 | A | 10/1934 | Davis |
| 2,066,473 | A | 1/1937 | Jorgensen |
| 2,325,811 | A | 8/1943 | Terrell |
| 2,354,887 | A | 8/1944 | Silverman |
| 2,664,272 | A | 12/1953 | Boice |
| 2,676,820 | A | 4/1954 | Boice |
| 2,995,552 | A | 9/1961 | Fox |
| 3,079,549 | A | 2/1963 | Martin |
| 3,085,939 | A | 4/1963 | Fitch |
| 3,125,173 | A | 3/1964 | Fox |
| 3,146,611 | A | 9/1964 | Fox |
| 3,175,374 | A | 3/1965 | Toelke |
| 3,186,222 | A | 6/1965 | Martin |
| 3,194,331 | A | 7/1965 | Arnold |
| 3,338,069 | A | 8/1967 | Ortloff |
| 3,360,960 | A | 1/1968 | Massey |
| 3,554,307 | A | 1/1971 | Yount |
| 3,606,402 | A | 9/1971 | Medney |
| 3,773,359 | A | 11/1973 | Chance |
| 3,793,632 | A | 2/1974 | Still |
| 3,876,972 | A | 4/1975 | Garrett |
| 3,903,974 | A | 9/1975 | Cullen |
| 3,968,473 | A | 7/1976 | Patton |
| 4,204,707 | A | 5/1980 | Lincicome |
| 4,215,426 | A | 7/1980 | Klatt |
| 4,328,704 | A | 5/1982 | Arpasi |
| 4,365,678 | A | 12/1982 | Fitch |
| 4,460,202 | A | 7/1984 | Chance |
| 4,479,564 | A | 10/1984 | Tanguy |
| 4,683,944 | A | 8/1987 | Curlett |
| 4,722,402 | A | 2/1988 | Weldon |
| 4,785,247 | A | 11/1988 | Meador |
| 4,811,597 | A | 3/1989 | Hebel |

(Continued)

*Primary Examiner*—William P Neuder
(74) *Attorney, Agent, or Firm*—Tyson J. Wilde

(57) ABSTRACT

A downhole tool string component has a tubular body with a first and second end. At least one end is adapted for axial connection to an adjacent downhole tool string component. A covering, secured at its ends to an outside diameter of the tubular body, forms an enclosure with the tubular body. The covering has a geometry such that when a stress is induced in the sleeve by bending the downhole tool string component, that stress is less than or equal to stress induced in the tubular body. The covering may be a sleeve. Further, the geometry may comprise at least one stress relief groove formed in both an inner surface and an outer surface of the covering.

31 Claims, 15 Drawing Sheets

U.S. PATENT DOCUMENTS

| | | | | |
|---|---|---|---|---|
| 4,811,800 | A | 3/1989 | Hill | |
| 4,892,337 | A | 1/1990 | Gunderson | |
| 5,039,137 | A | 8/1991 | Cankovic | |
| 5,040,620 | A | 8/1991 | Nunley | |
| 5,040,622 | A | 8/1991 | Winship | |
| 5,248,857 | A | 9/1993 | Ollivier | |
| 5,334,801 | A | 8/1994 | Mohn | |
| 5,691,712 | A | 11/1997 | Meek | |
| 5,988,276 | A | 11/1999 | Oneal | |
| 6,012,744 | A | 1/2000 | Wilson | |
| 6,026,897 | A | 2/2000 | Pringle | |
| 6,655,452 | B2 | 12/2003 | Zillinger | |
| 6,851,489 | B2 | 2/2005 | Hinds | |
| 6,896,049 | B2 | 5/2005 | Moyes | |
| 6,903,660 | B2 * | 6/2005 | Clark et al. | 340/854.8 |
| 2003/0070842 | A1 | 4/2003 | Bailey | |
| 2004/0104821 | A1 * | 6/2004 | Clark | 340/854.6 |
| 2004/0184871 | A1 | 9/2004 | Luft | |
| 2005/0161215 | A1 * | 7/2005 | Hall et al. | 166/242.6 |
| 2006/0260801 | A1 * | 11/2006 | Hall et al. | 166/117.5 |

* cited by examiner

COMPLAINT COVERING OF A DOWNHOLE COMPONENT

BACKGROUND

Recent advances in downhole telemetry systems have enable high speed communication between downhole devices and the earth's surface. With these high speed communication abilities, more downhole devices may be utilized in downhole applications. Harsh downhole environments may subject downhole devices to extreme temperatures and pressures. Further, drilling and/or production equipment may apply potentially damaging forces to the downhole devices, such as tensile loads of a drill string, compression and tension from bending, thermal expansion, vibration, and torque from the rotation of a drill string.

U.S. Patent Publications 20050161215 and 20050001735, both to Hall, et al; which are both incorporated herein by reference for all that they contain; disclose a connection for retaining electronic devices within a bore of a downhole tool. The connection transfers a portion of the makeup load away from the electronic devices.

U.S. Pat. No. 6,075,461 issued Jun. 13, 2000 to Smith discloses an apparatus, method and system for communicating information between downhole equipment and surface equipment. An electromagnetic signal repeater apparatus comprises a housing that is securably mountable to the exterior of a pipe string disposed in a well bore. The housing includes first and second housing subassemblies. The first housing subassembly is electrically isolated from the second housing subassembly by a gap subassembly having a length that is at least two times the diameter of the housing. The first housing subassembly is electrically isolated from the pipe string and is secured thereto with a nonconductive strap. The second housing subassembly is electrically coupled with the pipe string and is secured thereto with a conductive strap. An electronics package and a battery are disposed within the housing. The electronics package receives, processes, and retransmits the information being communicated between the downhole equipment and the surface equipment via electromagnetic waves.

U.S. Pat. No. 6,655,452 issued Dec. 2, 2003 to Zillinger discloses a carrier apparatus for connection with a pipe string for use in transporting at least one gauge downhole through a borehole. The apparatus includes a tubular body for connection with the pipe string having a bore for conducting a fluid therethrough and an outer surface, wherein the outer surface has at least one longitudinal recess formed therein. Further, at least one insert defining an internal chamber for receiving a gauge is mounted with the body such that at least a portion of the insert is receivable within the recess for engagement therewith. The apparatus also includes an interlocking interface comprised of the engagement between the insert and the recess, wherein the interlocking interface is configured such that the insert inhibits radial expansion of the body adjacent the recess.

BRIEF SUMMARY OF THE INVENTION

In one aspect of the invention, a downhole tool string component has tubular body with a first and second end. At least one of the ends is adapted for axial connection to an adjacent downhole tool string component. A covering forms an enclosure with the tubular body and the covering is secured at a first and second covering end to an outside diameter of the tubular body. The covering also has a geometry such that the compliancy of the covering may be substantially equal to the compliancy of the tubular body.

In another aspect of the present invention, a downhole tool string component has a tubular body having a first and second end. Both ends are adapted for axial connection to an adjacent downhole tool string component. The tool string component may be a drill pipe, a drill collar, a reamer, a cross over sub, a swivel, a jar, a heavy weight pipe, a double shouldered pipe, a composite pipe, or a standard API pipe. The adjacent downhole tool string components may be drill pipe, drill collars, reamers, cross over subs, swivels, jars, hammers, heavy weight pipe, double shouldered pipe, composite pipe, and standard API pipe. A sleeve, coaxially secured at its sleeve ends to an outside diameter of the tubular body, forms an enclosure with the tubular body. The sleeve has an inner surface and an outer surface; both of these surfaces having at least one stress relief groove. Further stress relief grooves may also be formed in the tool string component. In one aspect of the present invention, there is a least one groove exposed within the enclosure.

The stress relief grooves allow the sleeve to be compliant with the tubular body such that the sleeve may conform more readily to whatever shape the tubular body takes on. In downhole drilling applications the tubular body may be bent, compressed, tensioned, or experience combinations thereof. Preferably, the sleeve is adapted to bend and stretch as the tubular body bends and stretches. The stress relief grooves may be perpendicular, parallel, or angled with respect to a central axis of the tool string component. In one aspect of the invention a stress relief groove may be segmented; in another aspect a stress relief groove is a spiral groove. The stress relief grooves may have a groove wall with multiple slopes. The grooves may have multiple portions which have different groove widths, different groove depths, different wall slopes, or different angles with respect to the axis of the tubular body. The groove formed in the inner surface and the groove formed in the outer surface may be offset. The offset may be approximately equal to the width of at least one of the grooves. In some aspects of the present invention, there may be a material, preferably a resilient material, which fills the grooves.

The sleeve may be secured to the tubular body through a means which includes thread forms, clamps, shoulders, keys, rope threads, welds, bolts, adhesives, or combinations thereof. There may be a sealing element disposed between the sleeve and the tubular body. The sleeve may be attached to an upset region of the tubular body. The enclosure may be partially formed by a recess formed in the upset. The sleeve may be made of material comprising beryllium cooper, steel, iron, metal, stainless steel, chromium, nickel, cooper, beryllium, aluminum, ceramics, alumina ceramic, boron, carbon, tungsten, titanium, composite fibers, combinations, mixtures, or alloys thereof. In one aspect of the present invention the sleeve may have a total radial expansion limit approximately equal to its thickness.

The tool string component may be divided into first and second coaxial sections with the sleeve being attached to the second section. In one aspect of the present invention, the second section may comprise substantially the same compliancy as the first section.

In certain aspects of the invention there may be electronic equipment disposed within the enclosure. The electronic equipment may be in communication with a downhole telemetry system such as a downhole network or a mud pulse system. The downhole telemetry system may be incorporated within the downhole tool string. Telemetry systems that may be compatible with the present invention include U.S. Pat. Nos. 6,670,880; 6,717,501; 6,929,493; 6,688,396; and 6,641,434, which are all herein incorporated by reference for all that they disclose. The telemetry system may be in communication with devices disposed within the enclosure, such as the aforementioned electronic equipment. The electronic equipment may be disposed within a recess formed in a spacer residing within the enclosure. Stress relief grooves may also be formed in the spacer. Examples of electronic equipment that may be disposed within the spacer are power sources, batteries, generators, circuit boards, sensors, seismic receivers, gamma ray receivers, neutron receivers, clocks, caches, optical transceiver, wireless transceivers, inclinometers, magnetometers, digital/analog converters, digital/optical converters, circuit boards, memory, strain gauges, temperature gauges, pressure gauges, actuators, and/or combinations thereof.

In another aspect of the invention, there is a sleeve adapted for connection to a downhole tool string component. The sleeve has an inner surface and an outer surface. The inner surface comprises at least one stress relief groove offset from another stress relief groove formed in the outer surface. The sleeve has a geometry such that even though the larger diameter of the sleeve has a greater surface displacement, the stress relief grooves create a stress in the sleeve that is less than or equal to the stress of the tubular body. When bending the sleeve the stress experienced by the outer surface may be equal to or less than 50% of the stress of the tubular body.

DETAILED DESCRIPTION OF THE INVENTION AND THE PREFERRED EMBODIMENT

Figure 1:
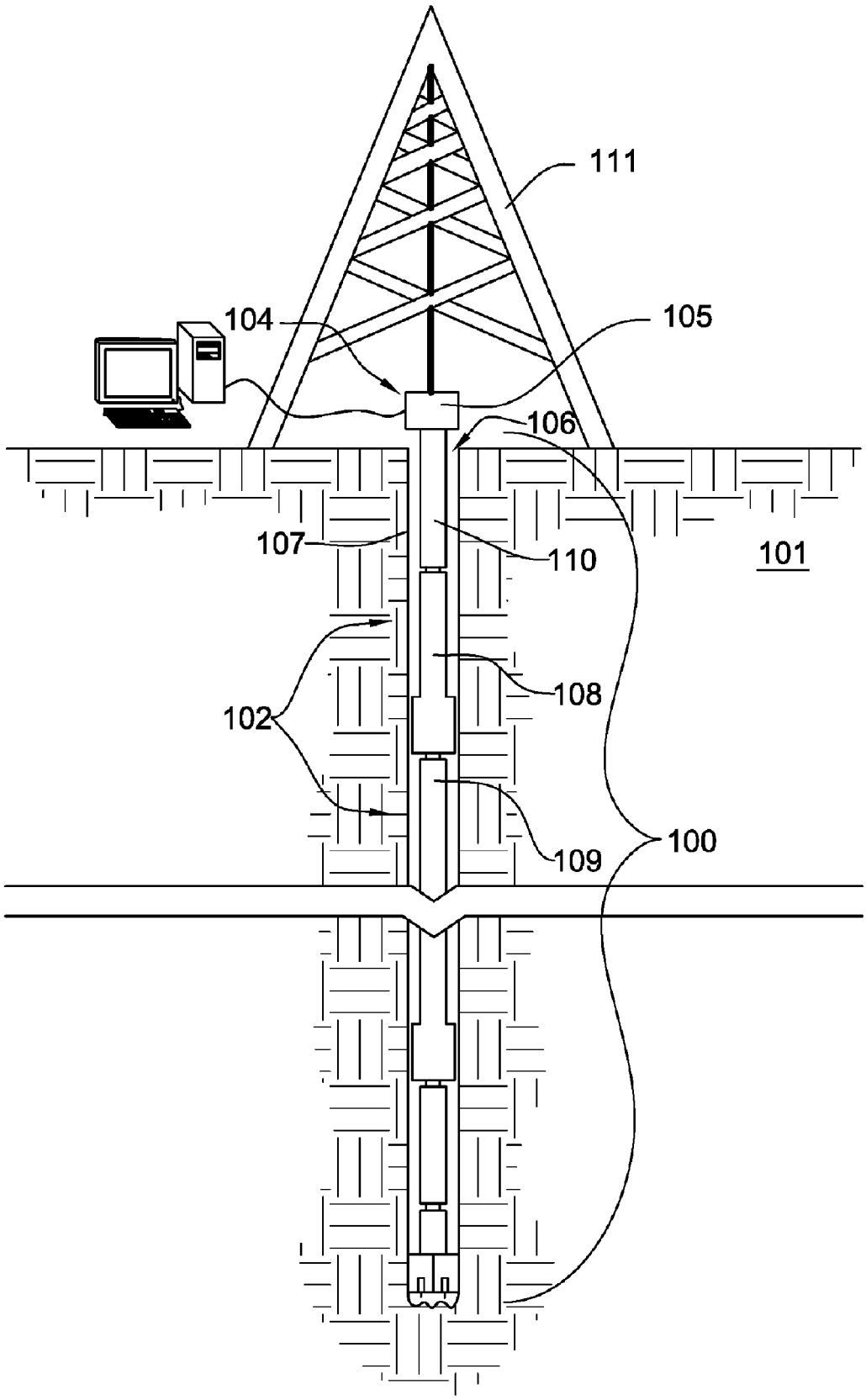
FIG. 1 is a perspective diagram of a downhole tool string suspended within the earth.

FIG. 1 is a perspective diagram of a downhole tool string 100 suspended within the earth 101. The tool string 100 shown is a drill string comprising a plurality 102 of tool string components 108, 109, 110. Surface equipment 103 is connected to a downhole telemetry system integrated within the tool string 100; the connection 104 being made through a swivel 105 located near an opening 106 of a well bore 107 formed by the tool string 100.

For purposes of simplicity, the specification will focus on tool string component 108, which is adapted for axial connection to adjacent tool string components 109 and 110; however, it is clear from FIG. 1 that more tool string components exist than 108, 109 and 110. Further, tool string component 108 as shown in FIG. 1 is a drill pipe, although it is within the scope of the claims for tool string component 108 to be selected from the group consisting of drill collars, reamers, cross over subs, swivels, jars, heavy weight pipe, double shouldered pipe, composite pipe, and standard API pipe. Tool string components 109 and 110 are also shown as drill pipe; but it is also within the scope of the claims for the adjacent tool string components 109 and 110 to be drill collars, reamers, cross over subs, swivels, jars, hammers, heavy weight pipe, double shouldered pipe, composite pipe, standard API pipe or combinations thereof. Further tool string components similar to 108, 109 and 110 may be distributed throughout the tool string 100.

Often the stresses felt by one tool string component on a tool string are different than stresses experienced by another tool string component on the same tool string. Typically all tool string components experience ambient downhole pressure pushing generally towards component's center, while pressure from drilling mud within the tool string component's bore generally pushes out radially. Often, during a drilling operation, a derrick 111 will pull up on a drill string causing many of the drill pipe to experience a degree of tension, while the drill collars, heavy weight pipe and other tool string components near the bottom of the well may still experience a degree of compression. Often, well bores are deviated causing tool string components to bend resulting in one portion of the downhole components experiencing a degree of compression and another portion experiencing a degree of tension. Further complications arise when a bending force is applied to a rotating tool string component subjecting at least most portions of the tool sting component to alternate between a degree of compression and tension.

Figure 2:
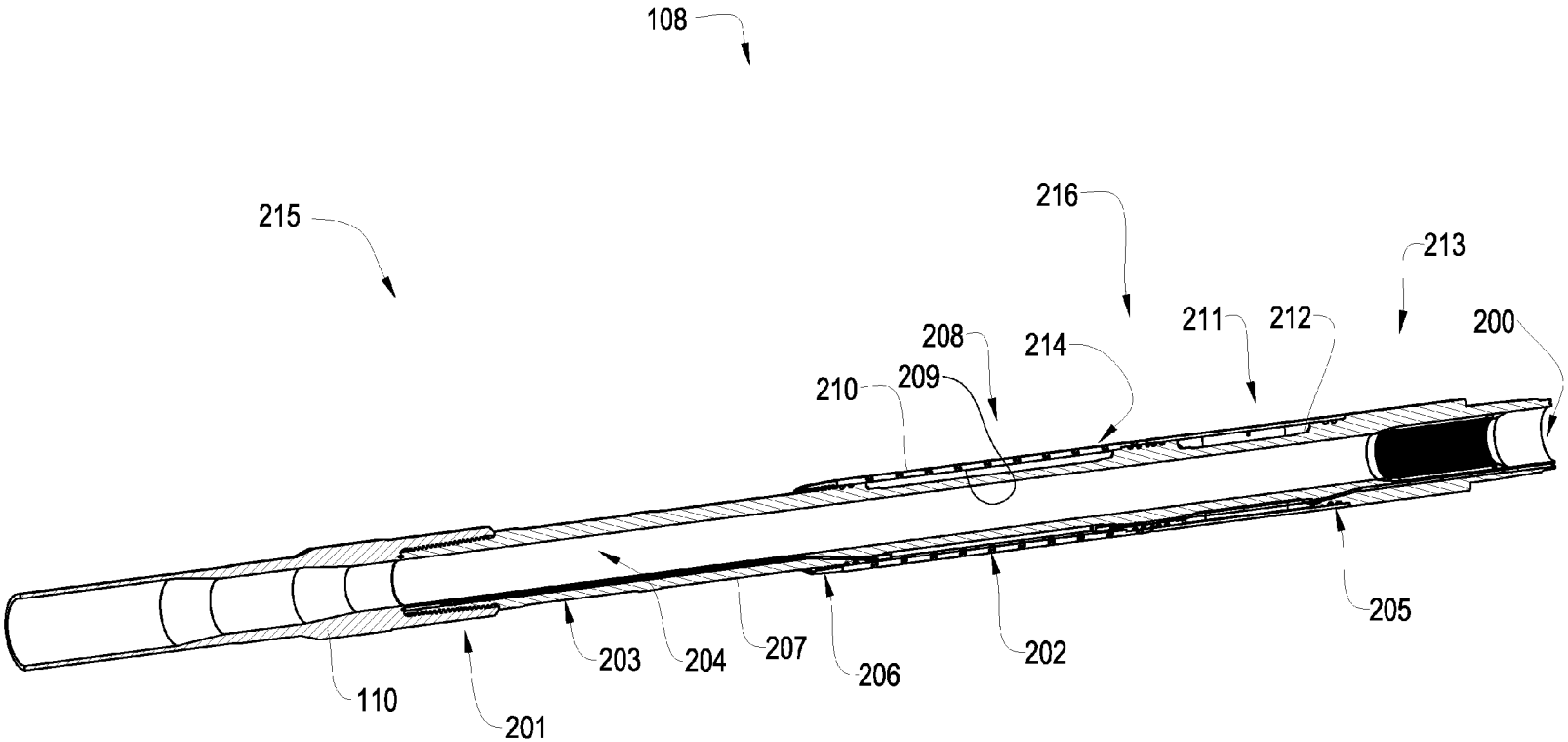
FIG. 2 is a cross sectional diagram of an embodiment of a downhole tool string component.
Figure 3:
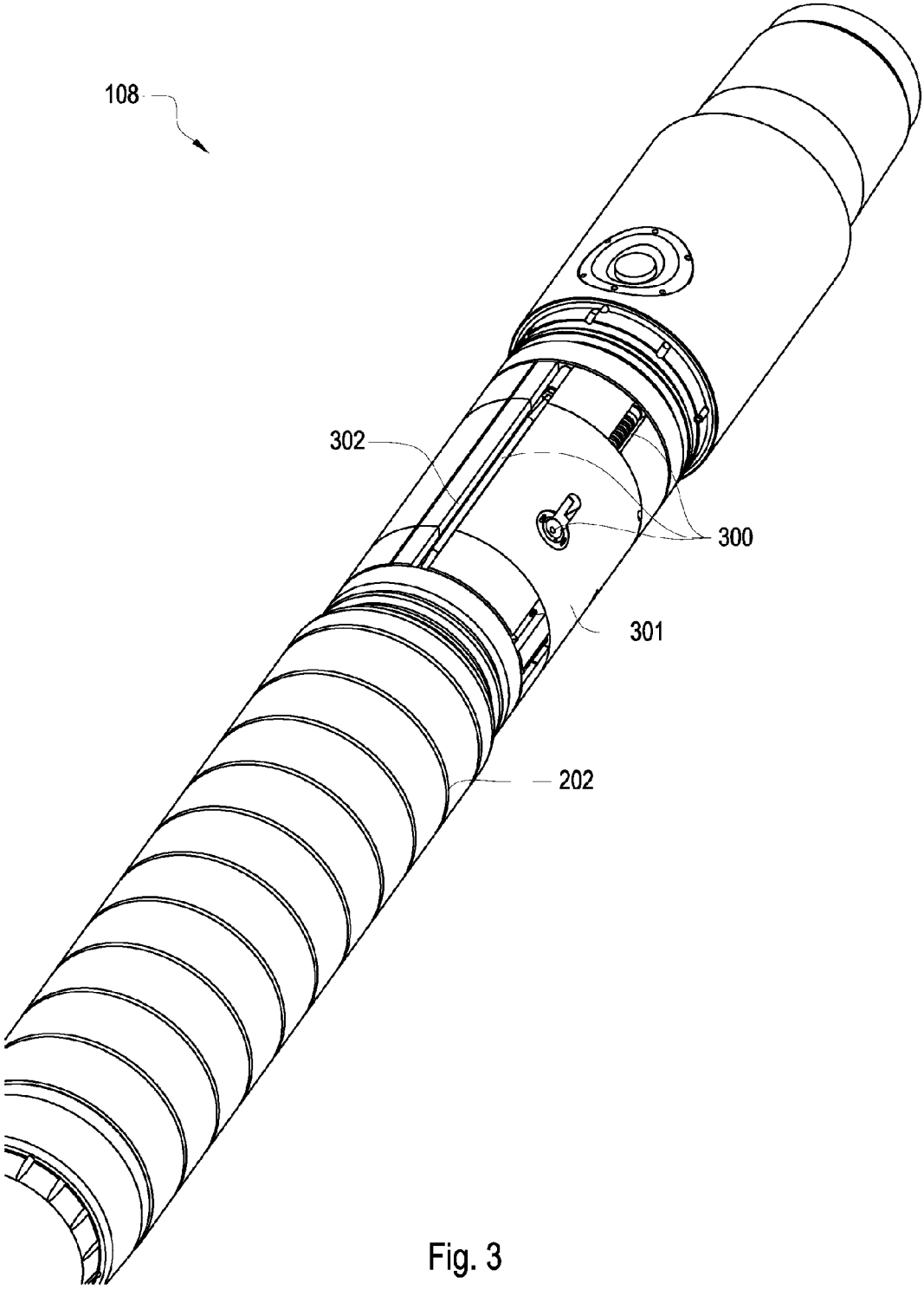
FIG. 3 is a perspective diagram of an embodiment of a downhole tool string component.
Figure 4:
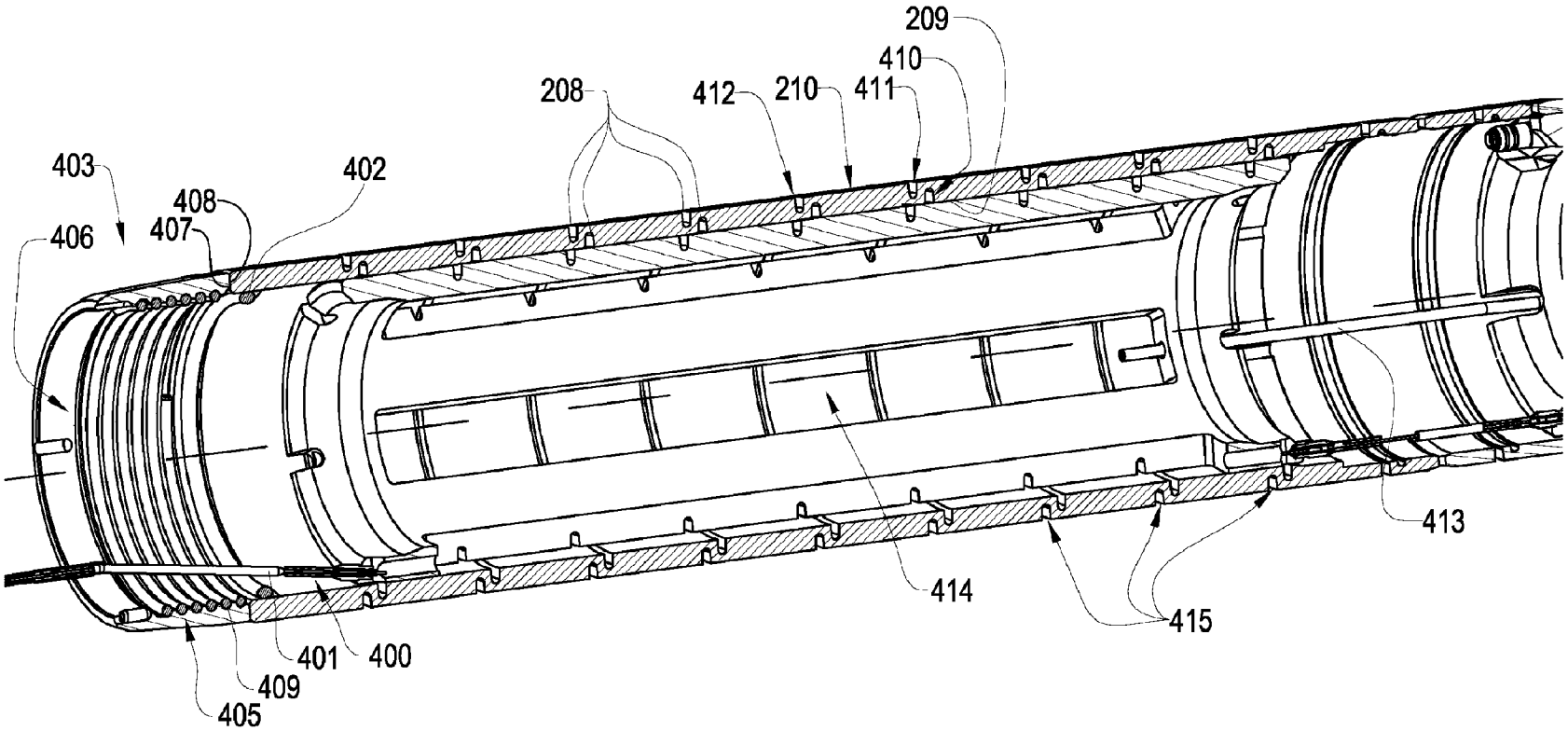
FIG. 4 is a cross sectional diagram of an embodiment of a covering.

FIG. 2 is a cross sectional diagram of an embodiment of downhole tool string component 108. Downhole tool string component 108 comprises a tubular body 203 with a central bore 204. A first end 200 of the tubular body 203 is adapted for axial connection to adjacent tool string component 109 and the other end 201 of the tubular body 203 is adapted for axial connection to adjacent tool string component 110. A compliant covering 202 is coaxially secured at a first end 205 and a second end 206 to an outside diameter 207 of the tubular body 203. This preferred embodiment of the covering 202 comprises at least one stress relief groove 208 formed in an inner surface 209 and an outer surface 210 of the covering 202. A closer view of the stress relief grooves 208 are shown in FIGS. 3 and 4 for clarity.

In the preferred embodiment of the invention, the covering is a sleeve. As shown in FIG. 2 there is at least one enclosure formed between the covering 202 and the tubular body 203. The first enclosure 211 is partially formed by a recess 212 in an upset region 213 of the first end 200 of the tubular body 203. A second enclosure 214 is also formed between the covering 202 and the tubular body 203.

The covering 202 may be made of a material comprising beryllium cooper, steel, iron, metal, stainless steel, austenitic stainless steels, chromium, nickel, cooper, beryllium, aluminum, ceramics, alumina ceramic, boron, carbon, tungsten, titanium, combinations, mixtures, or alloys thereof. The compliant covering 202 is also adapted to stretch as the tubular body 203 stretches. The stress relief grooves' 208 parameters should be such that the covering 202 will flex outward a maximum of twice its width under compression. Preferably, the complaint covering 202 may only have a total radial expansion limit approximately equal to the covering's thickness before the covering 202 begins to plastically deform. The tool string component 108 as shown in FIG. 2 has a first section 215 and a second section 216, where the covering 202 is attached to the second section 216. Preferably the covering 202 has a geometry which allows the second section 216, with the covering 202 attached, to have substantially the same compliancy as the first section 215.

The downhole tool string component 108 preferably comprises a seal between the covering 202 and the tubular body 203. This seal may comprise an O-ring or a mechanical seal. Such a seal may be capable to inhibiting fluids, lubricants, rocks, or other debris from entering into the enclosures 211 or 214.

FIG. 3 is also perspective diagram of an embodiment of a downhole tool string component 108. The portion of the covering 202 that forms the first enclosure 211 shown in FIG. 2 is absent in FIG. 3 for revealing the contents of the enclosure 211. Either enclosure 211 or 214 may comprise electronic equipment 300. Preferably, there is a spacer 301 disposed within the enclosure which comprises a recess 302 where the electronic equipment 300 may reside. The spacer 301 may be a cylinder that fills the volume of the enclosure and provides the tool string component 108 with additional hoop strength to resist downhole pressures. The spacer 301 may also have stress relief grooves 208 formed within its inner diameter, outer diameter, or both. Possible electronic equipment 300 that may reside within either enclosure 211 or 214 may be power sources, batteries, generators, circuit boards, sensors, seismic receivers, gamma ray receivers, neutron receivers, clocks, caches, optical transceiver, wireless transceivers, inclinometers, magnetometers, digital/analog converters, digital/optical converters, circuit boards, memory, strain gauges, temperature gauges, pressure gauges, actuators, and combinations thereof. It would be obvious to one of ordinary skill in the art to include as many enclosures as desired.

FIG. 4 is a cross sectional diagram of an embodiment of a covering 202. In certain embodiments of the present invention the electronic equipment 300 may communicate with a downhole telemetry system. This telemetry system may be of the kind disclosed in U.S. Pat. Nos. 6,670,880; 6,717,501; 6,929,493; 6,688,396; and 6,641,434 and U.S. Patent Publication Nos. 2005/0161215 and 2005/0001735. In other embodiments, the electronic equipment may be in communication with a mud pulse telemetry system. In other embodiments, there is no downhole telemetry system that communicates with the electronic equipment or other devices that may reside within the enclosure. These devices or electronic equipment may take measurements downhole and store them until they are retrieved later when the tool string component 108 is brought to the surface. Or the electronic equipment 300 or other devices may emit acoustic, electric, seismic, nuclear, gamma, or magnetic signals downhole. Such signals may be sensed from surface locations; subsurface locations, such as in cross well seismic applications; or other locations on the same tool string such as receivers distributed throughout the tool string.

The downhole telemetry system 400 may comprise a data transmission medium 401 such as an electric or optical cable. The cable may be secured within the bore of the tubular body. A hole may be drilled through the wall of the tubular body 203 before the covering 202 is secured providing a passage for the cable 401 to enter the enclosure. Such a method of manufacture would allow electronic equipment disposed within the enclosure to be in electrical or optical communication with a downhole telemetry system. Also in FIG. 4 a conduit 413 is disposed so as to allow communication between the first and the second enclosures 211 and 214.

Also shown in FIG. 4 is a sealing element 402, such as an O-ring, which may be disposed between the covering 202 and the tubular body 203 to form a seal there between. Also shown in FIG. 4 is a thread segment 403. The thread segment 403 is a ring with a threadform 405 in its inner surface 406. The segment 403 has a shoulder 407 adapted to abut a shoulder 408 of the covering 208. This particular thread segment 403 comprises a rope thread 409. The covering 202 may be slid over the tubular body 203 and be locked in the proper location by the thread segment 403. Other mechanisms for securing the covering 202 to the tubular body 203 may include clamps, keys, welds, bolts, adhesives or combinations thereof.

The stress relief grooves are also shown in FIG. 4. Preferably, the groove 410 formed in the inner surface 209 and the groove 411 formed in the outer surface 210 are offset from each other. Preferably, they are offset by a distance that it equal to the width of at least one of the grooves 410 or 411. Offset grooves 410 and 411 will be referred to as groove sets 412. The groove sets 412 may be spaced at equal distances from each other or they may be spaced at irregular distances. Preferably the groove sets 412 are generally uniform with each other, but at least one stress relief groove 208 may be non-uniform. At least one stress relief groove 208 may be perpendicular, parallel, or angled with respect to the axis 414 of the tool string component. The inner grooves 410 shown in FIG. 4 are exposed within the enclosure.

The stress relief grooves 208 may provide the covering 202 with distributed flexible locations 415 along the covering's length. This may allow the covering 202 to easily bend, stretch or conform to whatever shape the tubular body 203 is subjected to.

Figure 5:
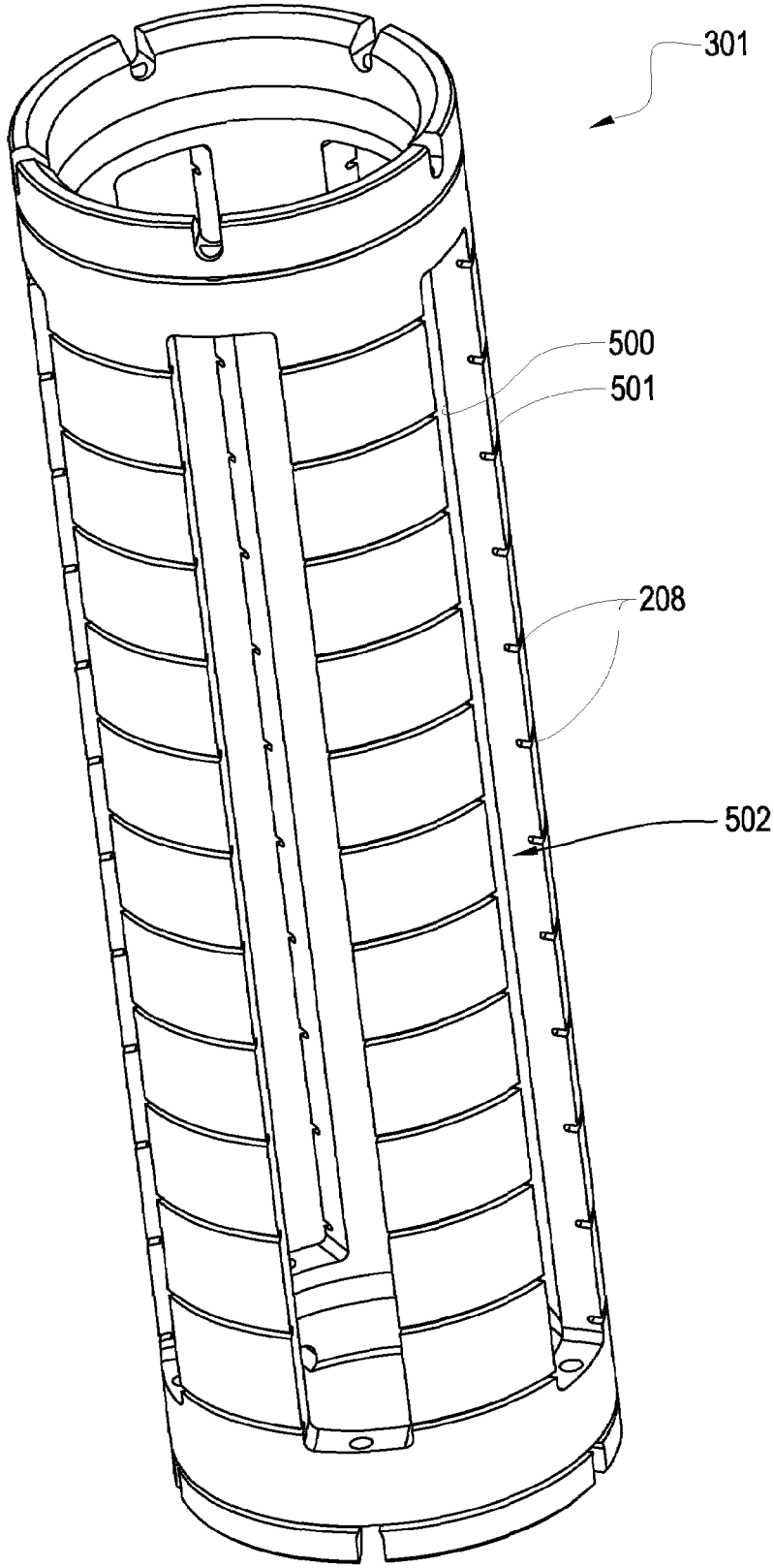
FIG. 5 is a perspective diagram of an embodiment of a spacer.

FIG. 5 is a perspective diagram of an embodiment of a spacer 301. The spacer 301 may also have stress relief grooves 208 formed in its inner surface 500, outer surface 501 or both. Since the inner and outer surfaces 500, 501 of the spacer 301 are closer to the axis 414 of the tool string component 108 the amount of stress felt by these surfaces 500, 501 may be less than that of the surfaces 210, 211 of the covering 202 so the stress relieved by the grooves 208 formed in the spacer may not be as great compared to the stress relieved from the grooves 208 formed in the covering 202.

A recess or pocket 502 may be formed in the spacer 301 to allow space for electronic equipment 300 and/or devices to reside. The structure of the spacer 301 may resist the ambient downhole pressure from crushing the electronic equipment 300 with the cover 202. The portion of the cover 202 that bridges the recess or pocket 502 formed in the spacer 301 may bow inward depending on the downhole ambient pressure. Preferably the spacer 301 is not fixed to the covering 202 or the tubular body 203. Often a downhole tool string component 108 will stretch due to the axial tensile forces it experiences. In such a case, the tubular body 203 and the covering 202 may stretch, but preferably the spacer's length will remain unaltered. Further, if the downhole tool string component 108 experiences axial compression, the spacer's length will preferably remain unaltered as well. However, when a bending force is applied to the downhole tool string component 108, the cover 202 or the tubular body 203 may engage the spacer 301 as they move, which will pass a bending force to the spacer 301 too. In such a situation, the spacer's stress relief grooves 208 may allow it to be complaint and reduce its stress.

Figure 6:
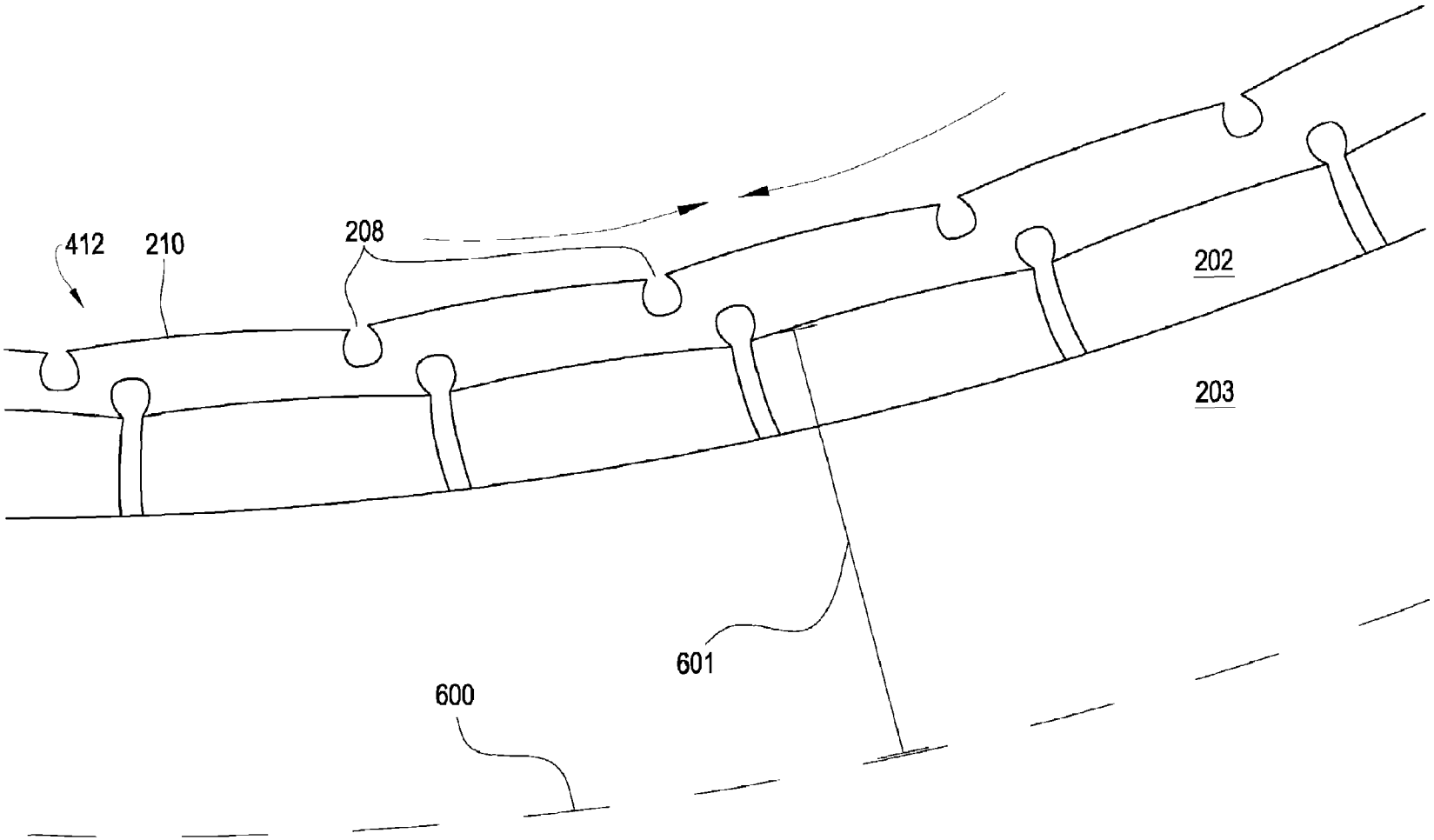
FIG. 6 is a cross sectional diagram of an embodiment of a downhole tool string component.

FIG. 6 is a cross sectional diagram of an embodiment of a downhole tool string component 108, specifically a portion of the downhole tool string component 108 under compression due to a bending force. The neutral axis 600 is the line of zero stress at which the fibers of the tool string component 108 are neither stretched nor compressed. In FIG. 6, the portion of the covering 202 above the neutral axis 600 experiences compression and the portion below the neutral axis experiences tension.

The covering 202 has a geometry such that even thought the larger diameter of the covering has greater surface displacement, the stress relief grooves create a stress in the sleeve that is less than or equal to the stress of the tubular body. When bending the covering the stress experienced by the outer surface may be equal to or less than 50% of the stress experienced by the tubular body.

The stress relief grooves 208 direct the strain that would normally be felt at the outer surface 210 of the covering 210 to the tubular body 203. In this manner, a covering may be added circumferentially around a tubular body 203 of a tool string component 108 and allow the tool string component 108 to be as complaint with the covering 202 attached as it would be without it attached. Typically in the art, a covering 202, such as a sleeve, attached circumferentially around the tubular body 203 will stiffen the tool string component 108.

The cover 202 typically bends at the narrowest cross sectional area in the groove sets 412. The rigid portions 603 intermediate the groove sets 412 may bend slightly under a bending force.

Figure 7:
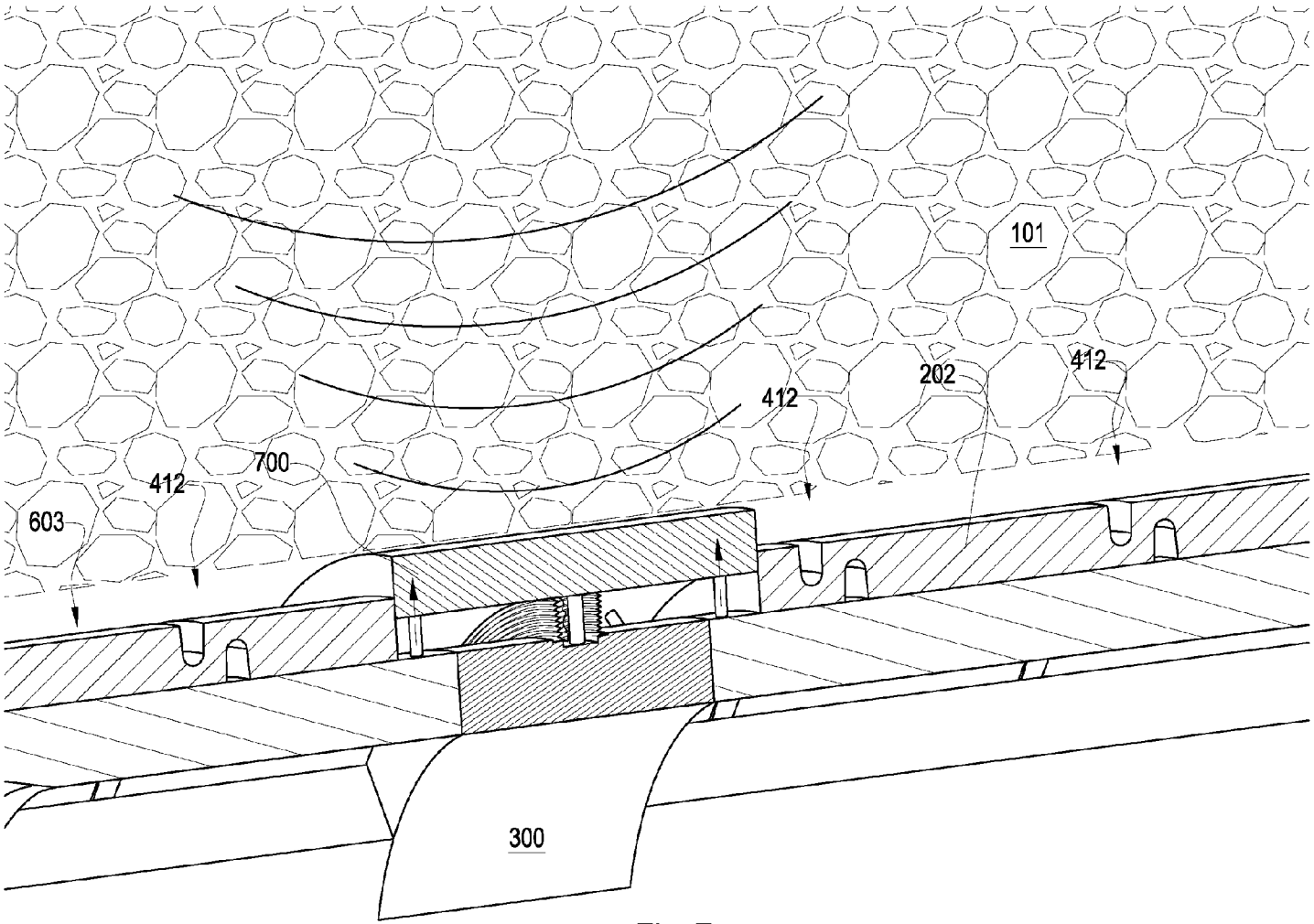
FIG. 7 is a perspective cross sectional diagram of an embodiment of electronic equipment.

FIG. 7 is a perspective cross sectional diagram of an embodiment of electronic equipment 300 receiving a signal from the earth 101. As shown in the figure, a sensing pad 700 may extend from the cover 202 to contact the earth 101. Since the groove sets 412 are flexible, it is preferable that the groove sets 412 do not lie over underlying electronic equipment 300, but that a rigid portion 603 of the cover 202 is adjacent the cover 202. In some embodiments it may be desirable to use a cover 202 made of non-magnetic material such as beryllium copper or austenitic stainless steels. A non-magnetic covering may allow magnetic readings to be taken without the covering's properties creating a magnetic interference. A covering made of alumina ceramic may also be desirable since it is transparent to a wide variety of wavelengths and electromagnetic radiation. Further other materials may be selected for the covering 202 based off of their magnetic, nuclear, electric, or elastic properties. Alumina ceramic is typically stiffer than steel, but the number, parameters, and configuration of the grooves sets may be arranged such to tailor an alumina ceramic covering to be complaint with a typical tubular body.

Figure 8:
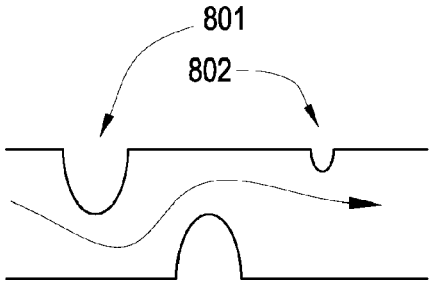
FIG. 8 is a cross sectional diagram of an embodiment of a groove.
Figure 9:
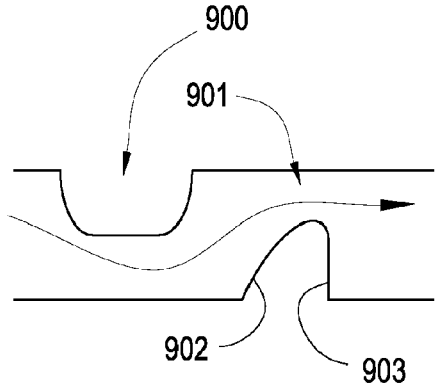
FIG. 9 is a cross sectional diagram of another embodiment of a groove.
Figure 10:
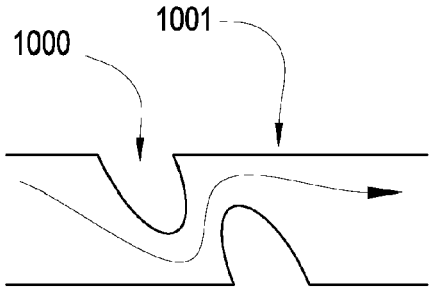
FIG. 10 is a cross sectional diagram of another embodiment of a groove.
Figure 11:
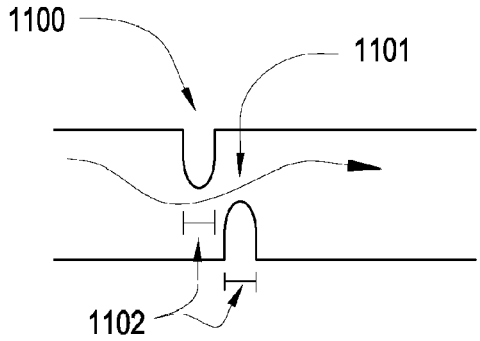
FIG. 11 is a cross sectional diagram of another embodiment of a groove.

FIGS. 8-11 are cross sectional diagrams of groove embodiments. There are many stress relief groove configurations that affect strain, some of which are depicted in the following figures. Adjusting the parameters of the stress relief grooves to tailor the groove characteristics affecting strain is within the scope of the claims. Stain is represented by arrow 800. FIG. 8 shows a primary outer groove 801 accompanied by a minor outer groove 802. FIG. 9 shows an outer groove 900 which is wider than the inner groove 901. The inner groove 901 comprises groove walls 902, 903 that have different slopes. FIG. 10 shows outer and inner grooves 1000, 1001 angled towards each other. FIG. 11 shows an outer and an inner groove 1100, 1101 with narrow groove widths 1102.

Figure 12:
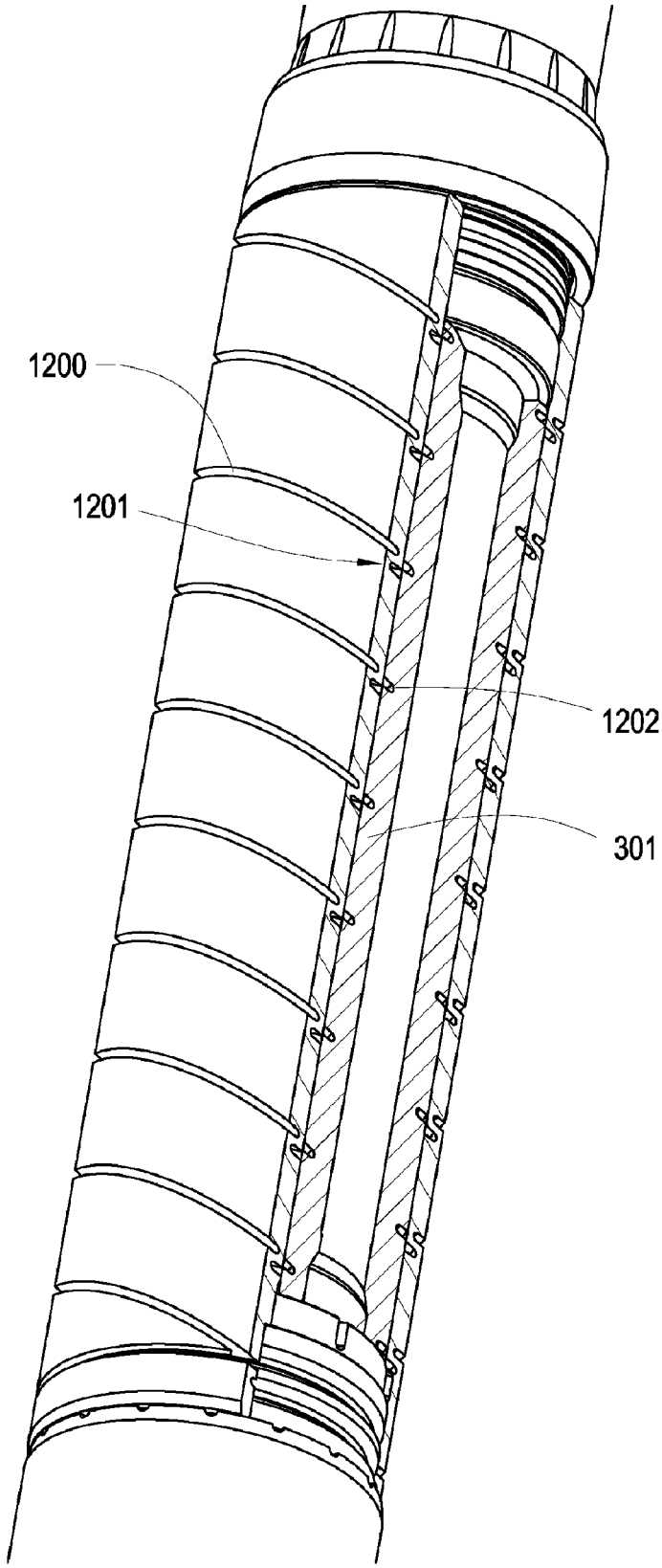
FIG. 12 is a perspective sectional diagram of an embodiment of a covering.
Figure 13:
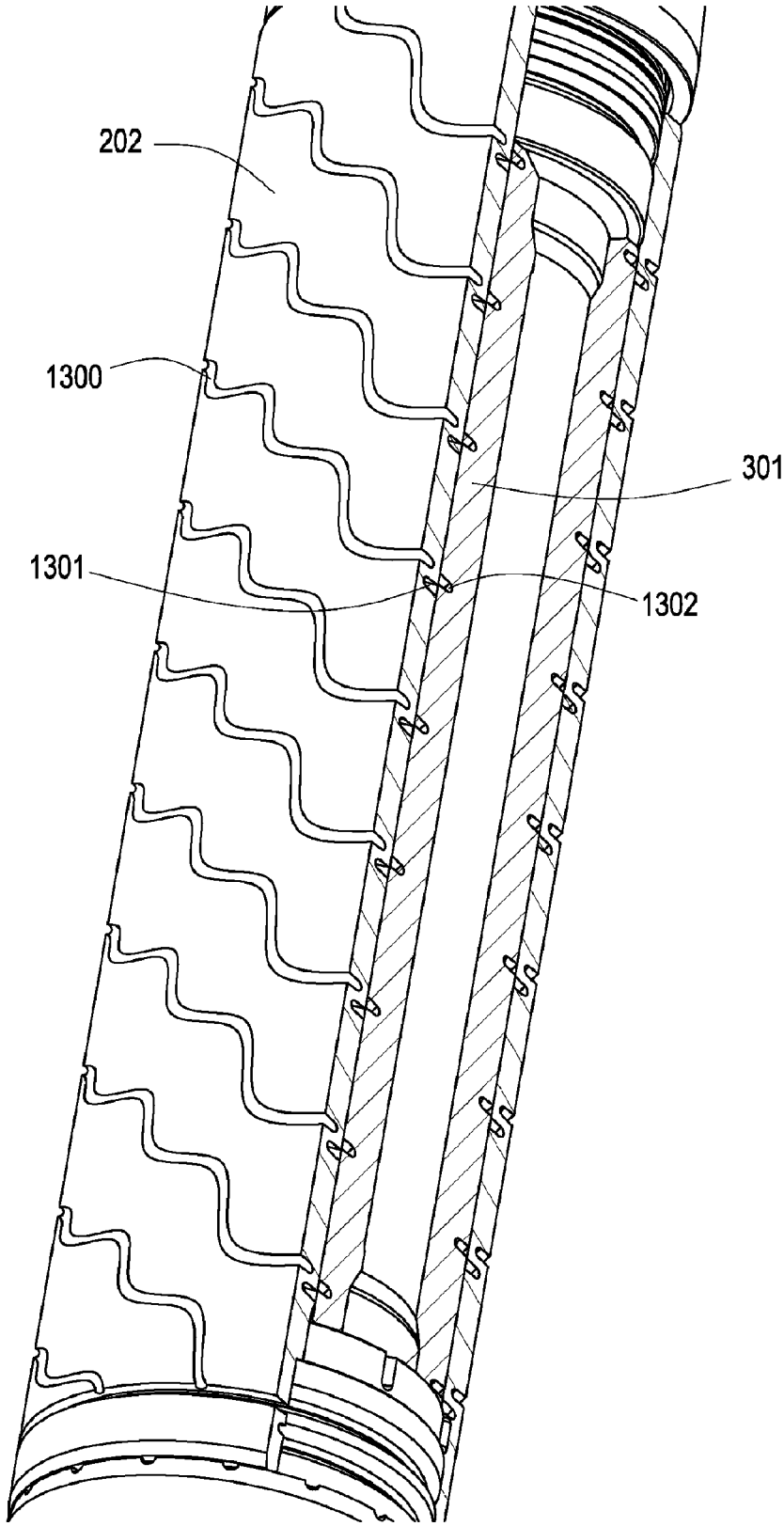
FIG. 13 is a perspective sectional diagram of another embodiment of a covering.

FIGS. 12-16 are perspective sectional diagrams of covering embodiments. At least one stress relief groove may comprise multiple portions. The portion may have different groove widths, different groove depths, different wall slopes, or different angles with respect to the axis of the tubular component. Some stress relief grooves may also be segmented. FIG. 12 shows an outer spiral groove 1200 with multiple thread starts. The inner groove 1201 corresponds with the outer groove 1200. A spiral groove 1202 in the spacer 301 also corresponds with the inner and outer grooves 1200, 1201. It is believed that helical, spiral, or wave shaped grooves may help relieve some torsional stress. FIG. 13 shows a wave shaped outer groove 1300. The inner groove 1301 of the cover 202 and also the outer groove 1302 of the spacer 301 are also wave shaped and correspond with the outer groove 1300.

Figure 14:
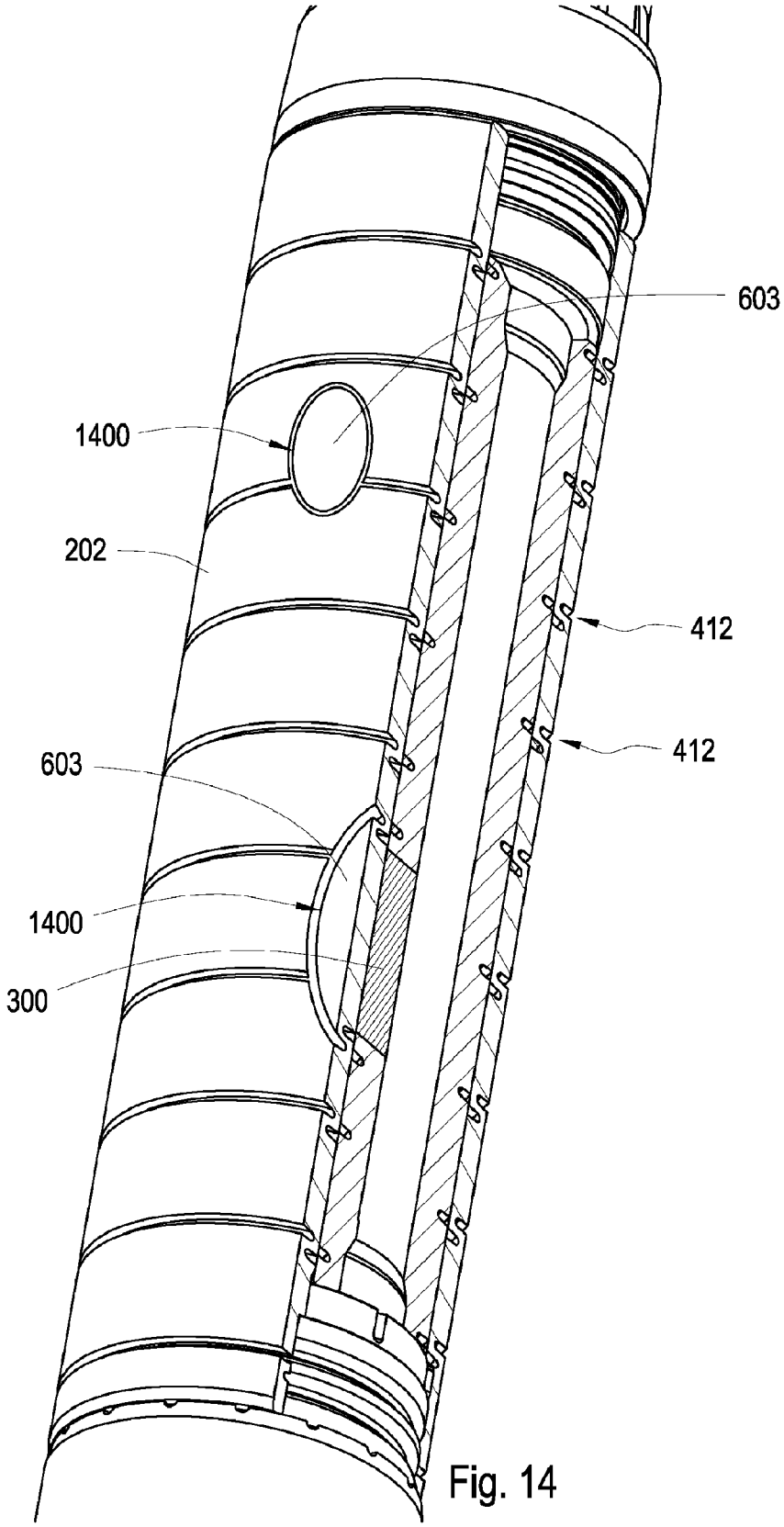
FIG. 14 is a perspective sectional diagram of another embodiment of a covering.
Figure 15:
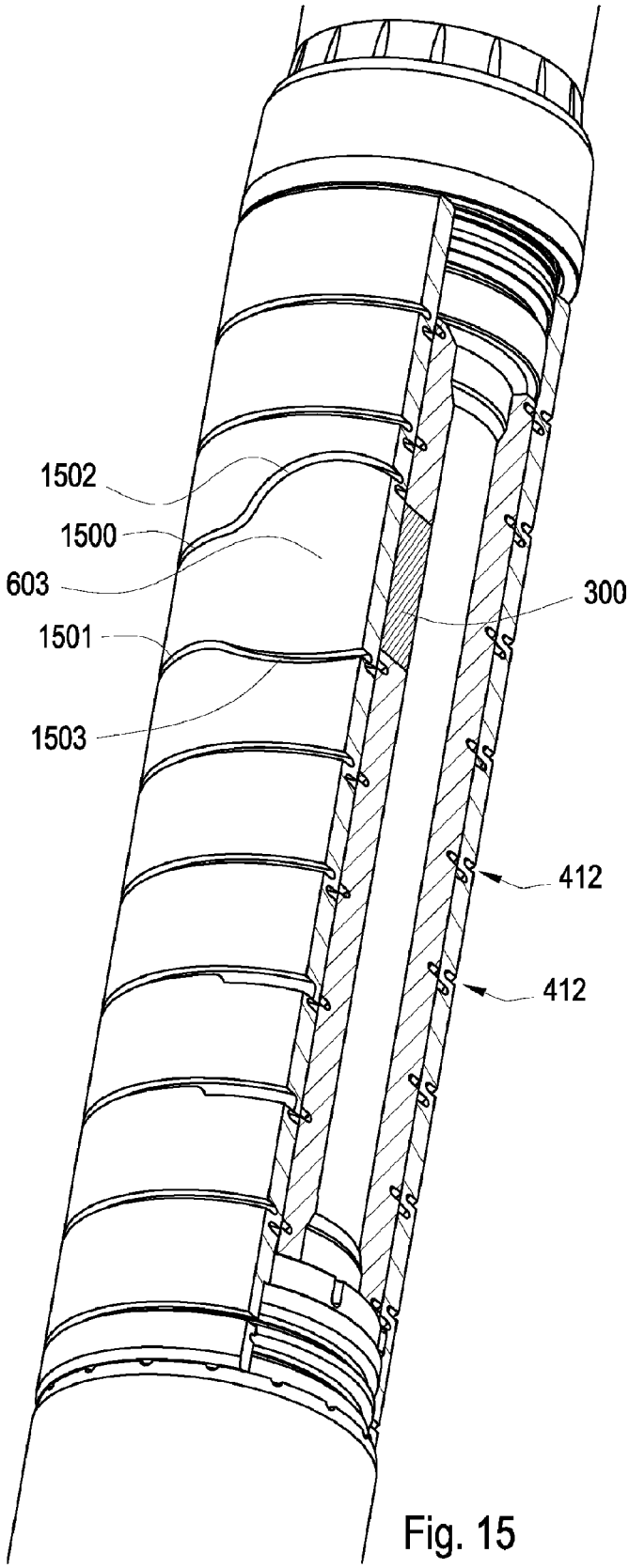
FIG. 15 is a perspective sectional diagram of another embodiment of a covering.
Figure 16:
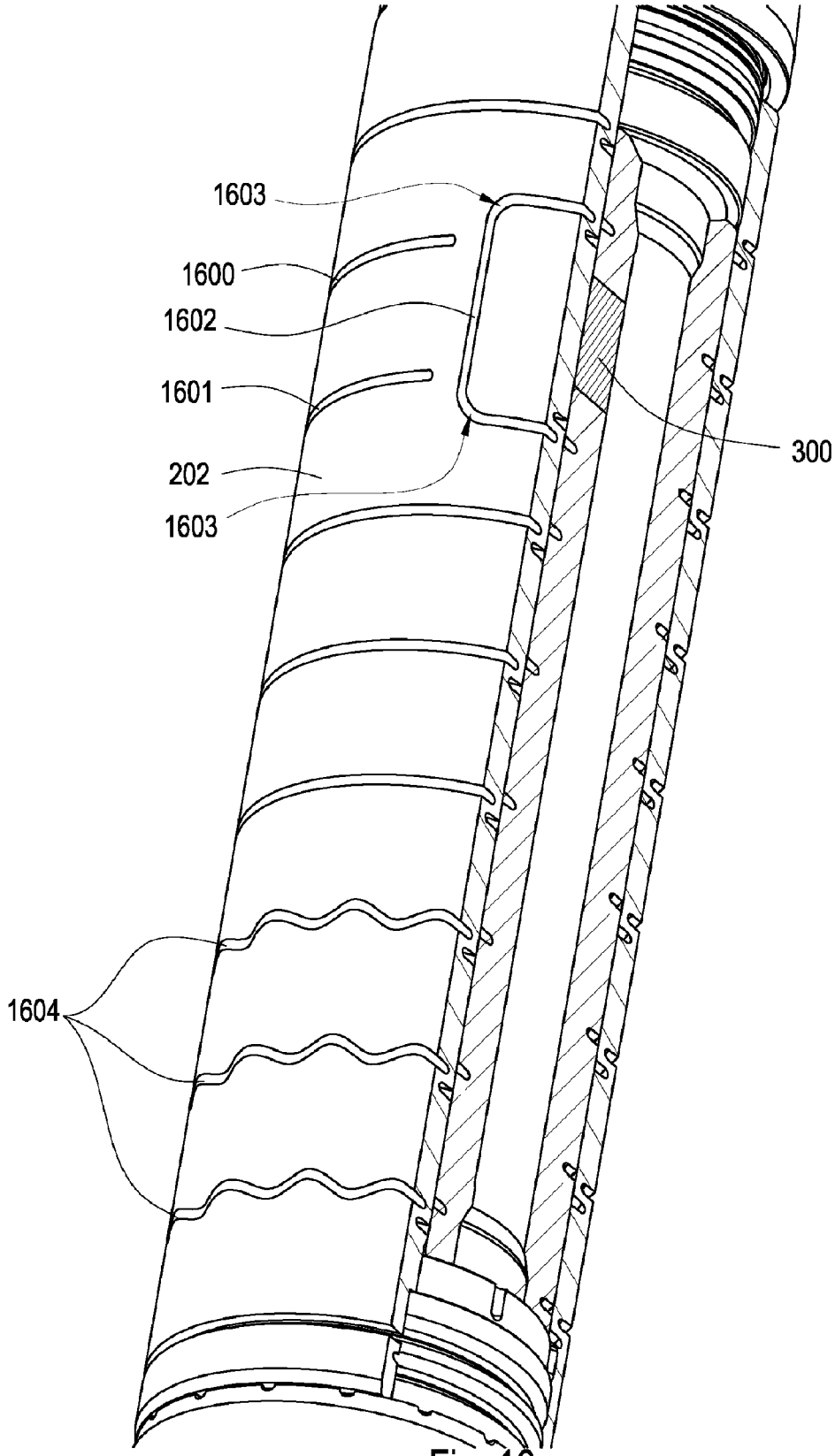
FIG. 16 is a perspective sectional diagram of another embodiment of a covering.

FIG. 14 shows annular groove sets 412 with occasional circular groove sets 1400. The area circumscribed by the circular grooves sets 1400 may have underlying devices or underlying electronic equipment 300. The circular groove sets 1400 provide a rigid portion 603 of the cover 202 that allows the cover 202 to flex in a location other than the location adjacent the underlying device or underlying electronic equipment 300. Such an arrangement avoids applying stresses to the underlying devices or equipment 300. FIG. 15 shows annular groove sets 412, with some of the groove sets 1500 and 1501 comprising a curved section 1502, 1503. The curved sections 1502, 1503 allow for rigid portions 603 of the cover 202 to be shaped to meet the needs of the underlying devices or electronic equipment 300. FIG. 16 shows two groove sets 1600, 1601 that do not fully circumscribe the cover 202. A generally square shaped groove set 1602 with rounded edges 1603 creates a rigid portion 603 which protects underlying equipment 300. Other wave shaped groove sets 1604 are also depicted in FIG. 16.

Figure 17:
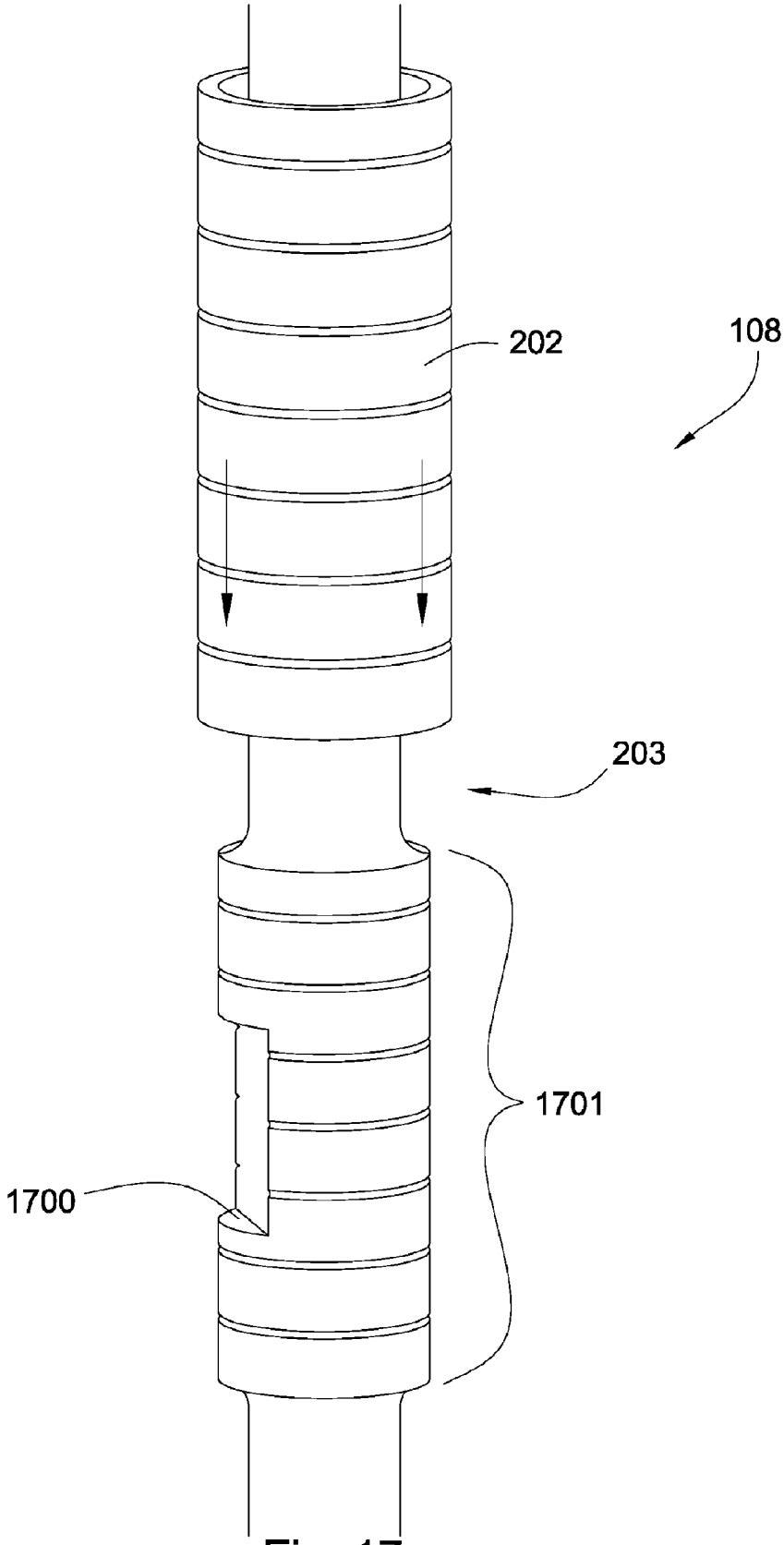
FIG. 17 is a perspective diagram of an embodiment of a downhole tool string component.

FIG. 17 is a perspective diagram of an embodiment of a downhole tool string component 108. A recess 1700 is formed in a grooved upset region 1701 of the tubular body 203. The cover 202 slides over the recess 1700 and may be secured to the tubular body 203 in a manner described in FIG. 4. Electronic equipment may reside in the recess 1700. A cable (not shown) may reside in a gun drilled hole connecting the recess 1700 to the bore of the tubular body 203; thereby allowing any device residing in the recess 1700 to communicate with a downhole telemetry system.

Figure 18:
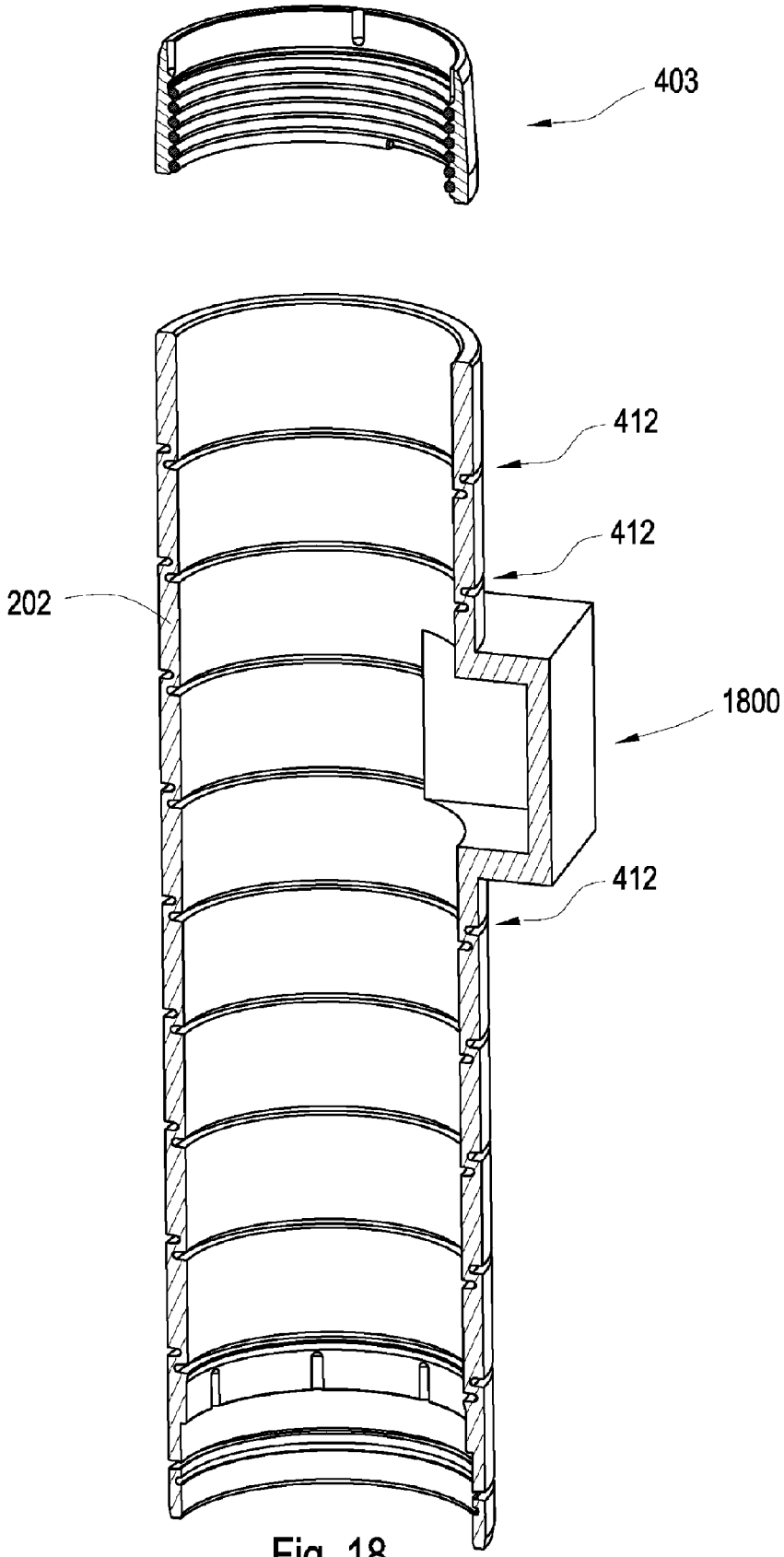
FIG. 18 is a perspective sectional diagram of another embodiment of a covering.

FIG. 18 is a perspective sectional diagram of another embodiment of a covering 202. The covering 202 comprises a radially extending portion 1800 which may be substantially insulated from the strain due to the groove sets 412 formed in the covering 202. Electronic equipment may be disposed within the radially extending portion 1800 of the covering 202 during a downhole operation. A thread segment 403 is also shown, illustrating a possible mechanism for securing the cover 202 to the tubular body 203.

Whereas the present invention has been described in particular relation to the drawings attached hereto, it should be understood that other and further modifications apart from those shown or suggested herein, may be made within the scope and spirit of the present invention.

What is claimed is:

1. A downhole tool string component, comprising:

a tubular body with a first and second end; at least one end being adapted for axial connection to an adjacent downhole tool string component;

a sleeve, coaxially secured at a first and second sleeve end to an outside diameter of the tubular body, forms an enclosure with the tubular body;

the sleeve comprising an inner surface and an outer surface; wherein both surfaces of the sleeve comprise at least one stress relief groove.

2. The tool string component of claim 1, wherein a sealing element is disposed between the sleeve and the tubular body.

3. The tool string component of claim 1, wherein the sleeve is secured to the tubular body by means comprising thread forms, clamps, shoulders, keys, rope threads, welds, bolts, adhesives, or combinations thereof.

4. The tool string component of claim 1, wherein the sleeve is attached to an upset region of the tubular body.

5. The tool string component of claim 1, wherein the sleeve is made of a material comprising beryllium cooper, steel, iron, metal, stainless steel, austenitic stainless steel, chromium, nickel, cooper, beryllium, aluminum, ceramics, alumina ceramic, boron, carbon, tungsten, titanium, combinations, mixtures, or alloys thereof.

6. The tool string component of claim 1, wherein the sleeve has a total radial expansion limit approximately equal to its thickness.

7. The tool string component of claim 1, wherein the sleeve is adapted to stretch with the tubular body under tensile forces.

8. The tool string component of claim 1, wherein tool string component comprises a first coaxial section and a second coaxial section, the sleeve being attached to the second section.

9. The tool string component of claim 8, wherein the second section comprises a compliancy substantially the same as the first section.

10. The tool string component of claim 1, wherein the tool string component is selected from the group consisting of drill pipe, drill collars, reamers, cross over subs, swivels, jars, heavy weight pipe, double shouldered pipe, composite pipe, and standard API pipe.

11. The tool string component of claim 1, wherein the adjacent tool string components are selected from the group consisting of drill pipe, drill collars, reamers, cross over subs, swivels, jars, hammers, heavy weight pipe, double shouldered pipe, composite pipe, standard API pipe and combinations thereof.

12. The tool string component of claim 1, wherein the tool string component comprises a telemetry system.

13. The tool string component of claim 12, wherein the telemetry system communicates with devices disposed within the enclosure.

14. The tool string component of claim 1, wherein the enclosure is partially formed by a recess in an upset portion of the tubular body.

15. The tool string component of claim 1, wherein the enclosure comprises electronic equipment.

16. The tool string component of claim 15, wherein the electronic equipment is disposed within a recess formed in a spacer residing within the enclosure.

17. The tool string component of claim 16, wherein stress relief grooves are formed in the spacer.

18. The tool string component of claim 15, wherein the electronic equipment is selected from the group consisting of power sources, batteries, generators, circuit boards, sensors, seismic receivers, gamma ray receivers, neutron receivers, clocks, caches, optical transceiver, wireless transceivers, inclinometers, magnetometers, digital/analog converters, digital/optical converters, circuit boards, memory, strain gauges, temperature gauges, pressure gauges, actuators, and combinations thereof.

19. The tool string component of claim 1, wherein at least one stress relief groove is perpendicular, parallel, or angled with respect to the axis of the tool string component.

20. The tool string component of claim 1, wherein at least one stress relief groove is segmented.

21. The tool string component of claim 1, wherein at least one stress relief groove comprises groove walls comprising multiple slopes.

22. The tool string component of claim 1, wherein at least one stress relief groove is a spiral groove.

23. The tool string component of claim 1, wherein at least one stress relief groove comprises multiple portions, wherein the multiple portions of the groove comprise different groove widths, different groove depths, different wall slopes, or different angles with respect to the axis of the tubular component.

24. The tool string component of claim 1, wherein the groove formed in the inner surface and the groove formed in the outer surface are offset.

25. The tool string component of claim 24, wherein the offset is approximately equal to the width of at least one of the grooves.

26. The tool string component of claim 1, wherein stress relief grooves are formed in the tool string component.

27. The tool string component of claim 1, wherein at least one of the grooves is exposed within the enclosure.

28. The tool string component of claim 1, wherein the geometry of the sleeve is such that when stress is induced in the sleeve by bending the downhole tool string component, that stress is less than or equal to the stress induced in the tubular body.

29. A downhole tool string component, comprising:

a tubular body with a first and second end; at least one end being adapted for axial connection to an adjacent downhole tool string component;

a covering, secured at a first and second covering end to an outside diameter of the tubular body, forms an enclosure with the tubular body;

the covering has a geometry such that when stress is induced in the sleeve by bending the downhole tool string component, that stress is less than or equal to stress induced in the tubular body.

30. The tool string component of claim 29, wherein the covering is a sleeve.

31. The tool string component of claim 29, wherein the geometry comprises at least one stress relief groove formed in both an inner surface and an outer surface of the covering.

* * * * *